US009856623B2

(12) United States Patent
Kiest, Jr.

(10) Patent No.: US 9,856,623 B2
(45) Date of Patent: Jan. 2, 2018

(54) METHOD AND APPARATUS FOR SEALING AND STRUCTURALLY RENEWING A WALL OF A MANHOLE

(71) Applicant: LMK Technologies, LLC, Ottawa, IL (US)

(72) Inventor: Larry W. Kiest, Jr., Ottawa, IL (US)

(73) Assignee: LMK Technologies, LLC, Ottawa, IL (US)

( * ) Notice: Subject to any disclaimer, the term of this patent is extended or adjusted under 35 U.S.C. 154(b) by 0 days.

(21) Appl. No.: 15/442,092

(22) Filed: Feb. 24, 2017

(65) Prior Publication Data

US 2017/0167106 A1 Jun. 15, 2017

Related U.S. Application Data

(62) Division of application No. 13/843,352, filed on Mar. 15, 2013, now Pat. No. 9,611,613.

(51) Int. Cl.

| | |
|---|---|
| ***B29C 63/00*** | (2006.01) |
| ***B32B 43/00*** | (2006.01) |
| ***B32B 3/00*** | (2006.01) |
| ***F16L 55/00*** | (2006.01) |
| ***F16L 5/00*** | (2006.01) |
| ***F16L 1/00*** | (2006.01) |
| ***E04B 1/00*** | (2006.01) |
| ***E02D 29/12*** | (2006.01) |

(52) U.S. Cl.

CPC ..... *E02D 29/128* (2013.01); *E02D 2300/002* (2013.01); *E02D 2300/007* (2013.01)

(58) Field of Classification Search

CPC . B29C 63/00; B29C 63/0017; B29C 63/0021; B29C 63/0073; B29C 63/02; B29C 63/06; B29C 63/18; B29C 63/22; B29C 63/26; B29C 63/28; B29C 63/30; B29C 63/32; B29C 63/34; B29C 63/341; B29C 63/36; F16L 55/18; F16L 5/10; F16L 5/02; F16L 1/00; F16L 55/1608; E04B 1/00; E04B 1/62; B32B 43/00; B32B 3/06; B32B 3/20

See application file for complete search history.

(56) References Cited

U.S. PATENT DOCUMENTS

2007/0113519 A1* 5/2007 Kiest, Jr. ..... E02D 29/12 52/741.3
2012/0279600 A1* 11/2012 Kiest, Jr. ..... F16L 55/179 138/97

OTHER PUBLICATIONS

ATSAR-X11537-EP—European Search Report—dated Nov. 28, 2016.

* cited by examiner

*Primary Examiner* — Jacob T Minskey
*Assistant Examiner* — Matthew Hoover
(74) *Attorney, Agent, or Firm* — Nyemaster Goode, P.C.

(57) ABSTRACT

An apparatus and method is provided for structurally renewing and sealing a wall of a manhole. The apparatus includes a tubular sleeve impregnated with a hydrophilic or hydrophobic material capable of expanding when in contact with water, and a liner impregnated with a resinous material capable of curing and hardening. The apparatus is positioned in a manhole and inflated, which forces the tubular sleeve and the liner into contact with the wall of the manhole. The hydrophilic or hydrophobic material is forced into defects of the wall, thus sealing the wall, while the liner is allowed to cure and harden, thus structurally renewing the wall of the manhole.

10 Claims, 8 Drawing Sheets

METHOD AND APPARATUS FOR SEALING AND STRUCTURALLY RENEWING A WALL OF A MANHOLE

CROSS-REFERENCE TO RELATED APPLICATIONS

This is a divisional of U.S. patent application Ser. No. 13/843,352, filed Mar. 15, 2013, which application is hereby incorporated by reference in its entirety.

FIELD OF THE INVENTION

The present invention relates generally to a method and apparatus for repairing a wall of a manhole. More particularly, but not exclusively, it relates to a method and assembly for both sealing a wall of a manhole from groundwater leakage, and structurally renewing the wall of the manhole.

BACKGROUND OF THE INVENTION

Conventional manholes include a lower or bottom pad, a barrel having a relatively constant diameter adjacent the pad, a concentric or eccentric cone extending upwardly from the barrel, one or more adjusting rings to adjust the overall height of the manhole, and a casting frame on top of the adjusting rings to support a lid at an elevation substantially level with the surrounding pavement. The casting frame is preferably sealed to the uppermost adjusting ring to preclude or minimize water flow into the manhole. The cone and adjusting rings are commonly known as the manhole chimney. Most manhole structures are unique in size and shape with varying diameters and depths. Also, bricks often form a portion of the wall of a manhole.

Substandard construction methods can lead to damage or deterioration of the manhole structure. Thus, the manhole is vulnerable, allowing water and subsidence of soil to enter the manhole, which eventually leads to structural failure of the manhole.

One method of repairing manholes is the placement of a coating of a cementitious grout onto the interior surface of the manhole wall. The grout is applied in an uncured state and is permitted to cure. Methods of applying the grout include troweling the grout onto the wall of the manhole after spraying or slinging the grout onto the wall of the manhole. However, it is necessary for a person applying the grout to enter into the manhole. In addition, a final troweling step is usually required in order to obtain the desired compaction, surface, and thickness for the grout material.

Another method of repairing includes the use of cured-in-place (CIP) liners, which are coated with a resin. The liners are inserted into the manholes, and then expanded to contact the wall of the manhole. The CIP liners are then allowed to cure, which creates a new interior surface of the manhole wall. However, the wall may still contain cracks, joints, holes, or other defects that could be penetrated by ground water. The ground water could seep into the manhole, which would structurally weaken the wall of the manhole further. Additionally, if the defects are not sealed or the CIP liner is not permanently bonded to the manhole, water could seep down between the wall of the manhole and the CIP liner, and could weaken or damage the lower pad or pipes located at the bottom of the manhole.

Accordingly, there is a need in the art for an improved method and apparatus that overcomes the problems resulting from ground water being allowed to penetrate the wall of a manhole through defects and damages in the wall. There is also a need in the art for a method and apparatus for both sealing the wall of a manhole from ground water, while also structurally renewing the same wall at the same time.

BRIEF SUMMARY OF THE INVENTION

It is therefore a principal object, feature, or advantage of the present invention to provide an improved apparatus and method for repairing a wall of a manhole which improves over or solves the problems and deficiencies in the art.

Another object, feature, or advantage of the present invention is to provide an improved method and apparatus for repairing a wall of a manhole and preventing ground water from seeping through the wall of the manhole.

Another object, feature, or advantage of the present invention is to provide an improved method and apparatus that applies a hydrophobic material to a wall of a manhole to prevent ground water from leaking through the wall.

Another object, feature, or advantage of the present invention is to provide a method of applying a hydrophilic or hydrophobic material to joints, cracks, holes, or other defects in a wall of a manhole having different radii.

Another object, feature, or advantage of the present invention is to provide a method and apparatus for sealing and repairing a wall of a manhole wherein an expandable liner and bladder are bonded together forming an impermeable coating on the interior of a tubular sleeve to renew the structural integrity of the wall.

Another object, feature, or advantage of the present invention is to provide a method and apparatus for sealing and repairing a wall of a manhole wherein no bladder is required in order to inflate the liner and tubular sleeve to force the hydrophilic or hydrophobic material into the wall and to press the liner into contact with the tubular sleeve to repair the wall.

These and other objects, features, and advantages of the present invention will be apparent to those skilled in the art.

According to one aspect of the invention, a method of renewing a wall of a manhole is provided. The method includes taking a tubular sleeve including a hydrophobic material capable of curing and hardening, and expanding in the presence of water, and positioning the sleeve in the manhole. A liner, having a resinous material, is positioned within the tubular sleeve. The liner is then expanded outwardly until the liner forces the tubular sleeve against the wall of the manhole. The hydrophobic material from the tubular sleeve seals the wall of the manhole, and the resinous material of the liner cures and hardens, thus structurally renewing the wall of the manhole.

According to another aspect of the invention, a method of sealing ground water out of and structurally renewing a wall of a manhole is provided. The method includes impregnating a tubular sleeve with hydrophilic or hydrophobic material, and then inserting the tubular sleeve into the manhole. A liner, having each end open or the lower end closed, is impregnated with a resinous material capable of curing and hardening. The liner is inserted into the tubular sleeve, with the closed end being inserted first. The liner is then inflated to force the tubular sleeve and the liner into contact with the wall of the manhole, wherein the hydrophilic or hydrophobic material from the sleeve is forced into the cracks, joints, holes, and other defects in the wall. The resinous material of the liner is allowed to cure and harden, and then any pipe inlets are drilled open.

According to another aspect of the invention, a method of sealing ground water out of and structurally renewing a wall of a manhole is provided. The method includes impregnating a tubular sleeve with a hydrophilic or hydrophobic material, and then inserting the sleeve into the manhole. A liner, having been impregnated with a resinous material capable of curing and hardening, is inserted into the tubular sleeve. A bladder is then inserted into the liner. The bladder is inflated to stretch the liner and the tubular sleeve into contact with the wall of the manhole, wherein the sleeve is compressed forcing the hydrophilic or hydrophobic material into cracks, joints, holes, or other defects in the wall and into contact with ground water. The hydrophilic or hydrophobic material will then expand and seal the defects and provide a seal by bonding to the manhole wall. The resinous material of the liner is allowed to cure and harden, and the bladder is removed from the manhole.

According to yet another aspect of the invention, a liner assembly for sealing and structurally renewing a wall of a manhole is provided. The assembly includes a liner impregnated with a resinous material capable of curing and hardening. The assembly also includes a tubular sleeve that has been impregnated with a hydrophobic material capable of curing and expanding when in contact with water.

According to yet another aspect of the invention, a method of renewing and sealing a wall of a manhole is provided. The method includes structurally renewing the wall of the manhole by pressing a liner, impregnated with a resinous material capable of curing and hardening, against the wall of the manhole. The wall is sealed by pressing a tubular sleeve against the wall, the tubular sleeve being impregnated with a hydrophilic or hydrophobic material capable of curing and hardening when in contact with water.

According to a further aspect of the invention, a liner/bladder assembly for sealing and structurally renewing a wall of a manhole is provided. The assembly includes a tubular sleeve, a liner, and a bladder. The tubular sleeve is impregnated with a hydrophilic or hydrophobic material capable of curing and hardening and expanding, when in contact with water. The liner is impregnated with a resinous material capable of curing and hardening, and is positioned within the tubular sleeve. The bladder comprises a first closed end and an opposite closed second end connected to an air supply hose is positioned within the liner.

DETAILED DESCRIPTION OF THE PREFERRED EMBODIMENTS

Figure 1:
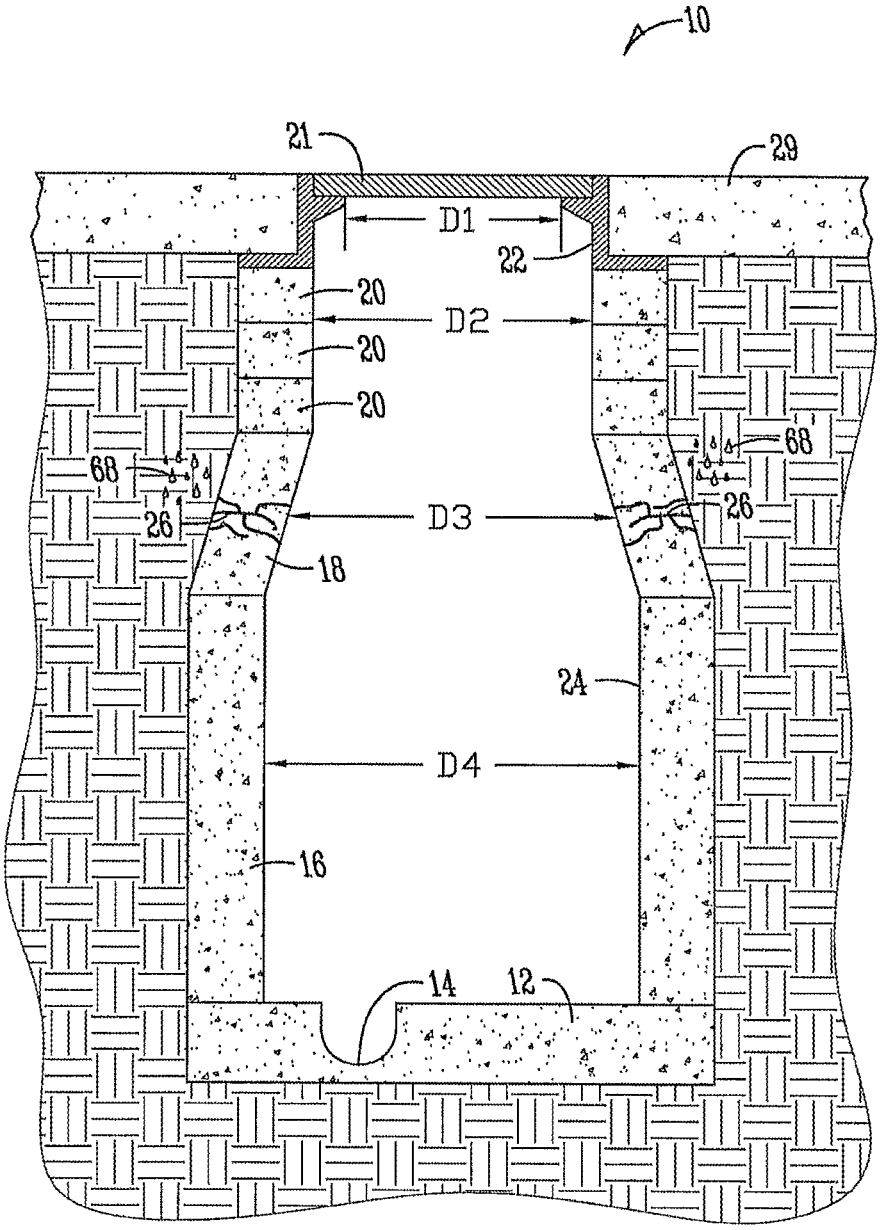
FIG. 1 is a sectional view of a manhole with defects in a wall of the manhole, before the repair method and apparatus of the present invention is used.

A typical manhole 10 has a bottom pad 12 that has a run through 14. The bottom pad 12 is attached to a barrel 16, a cone section 18, and a plurality of adjusting rings 20. A casting frame 22 is mounted at the upper end of the manhole 10. On top of the casting frame 22 sits a lid 21. As can be seen in FIG. 1, the manhole 10 has a number of diameters D1, D2, D3, and D4. The manhole wall 24 is usually formed of brick, and the bricks can become spaced from one another. In addition, defects 26, such as cracks, holes, or other problems, may form in the wall 24 of the manhole 10.

FIG. 1 shows a sectional view of a typical manhole 10, showing defects 26 that may occur in a wall 24 of the manhole 10. As the figure shows, the defects 26 may occur in, but are not limited to, the manhole cone 18. Also shown in FIG. 1, ground water 68 can be found outside of the manhole 10. The ground water 68 may seep into the defects 26 of the manhole wall 24, which could further weaken the wall and could potentially cause a collapse of the manhole 10.

Figure 2:
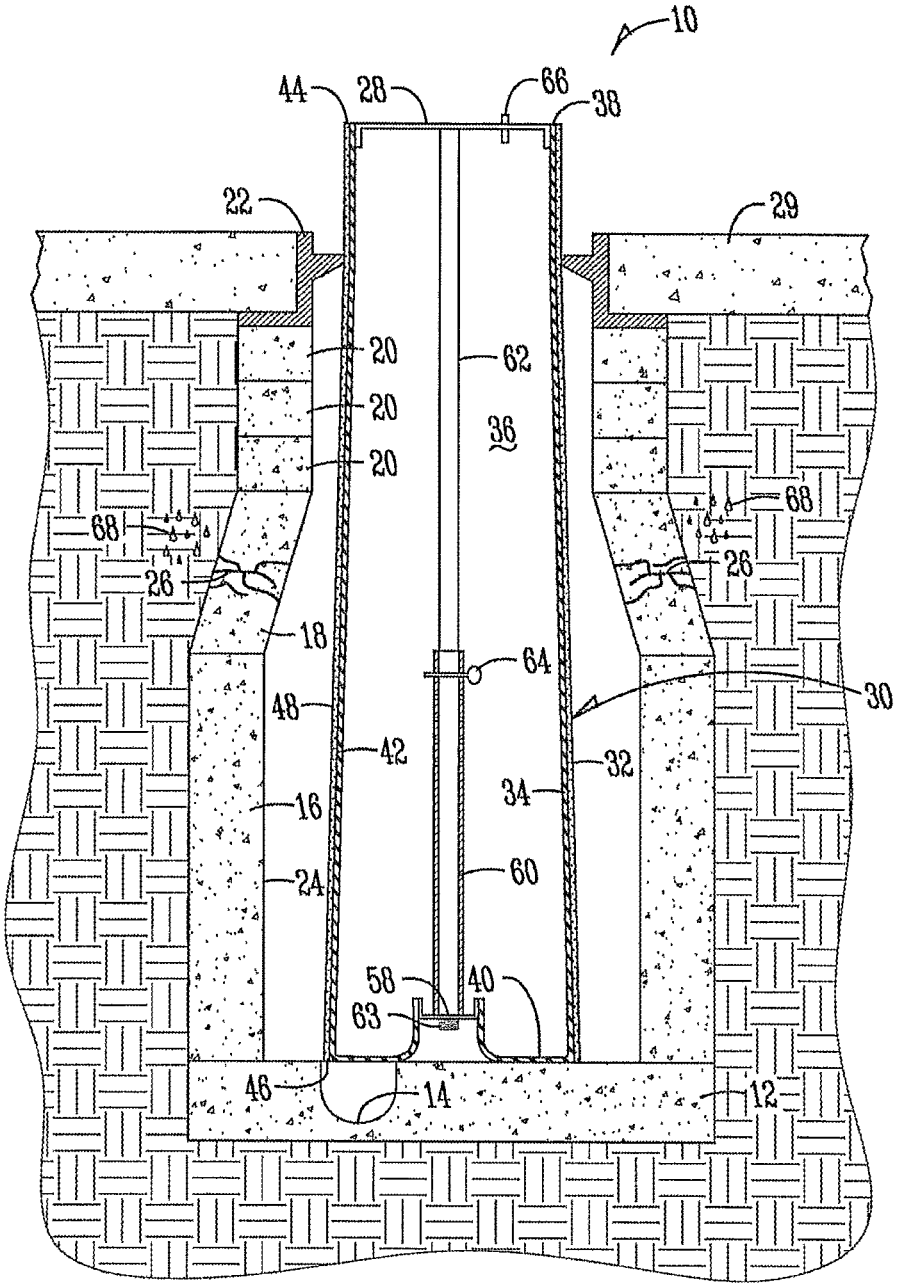
FIG. 2 is a sectional view of a manhole with defects in a wall of the manhole, showing one embodiment of the present invention.
Figure 3:
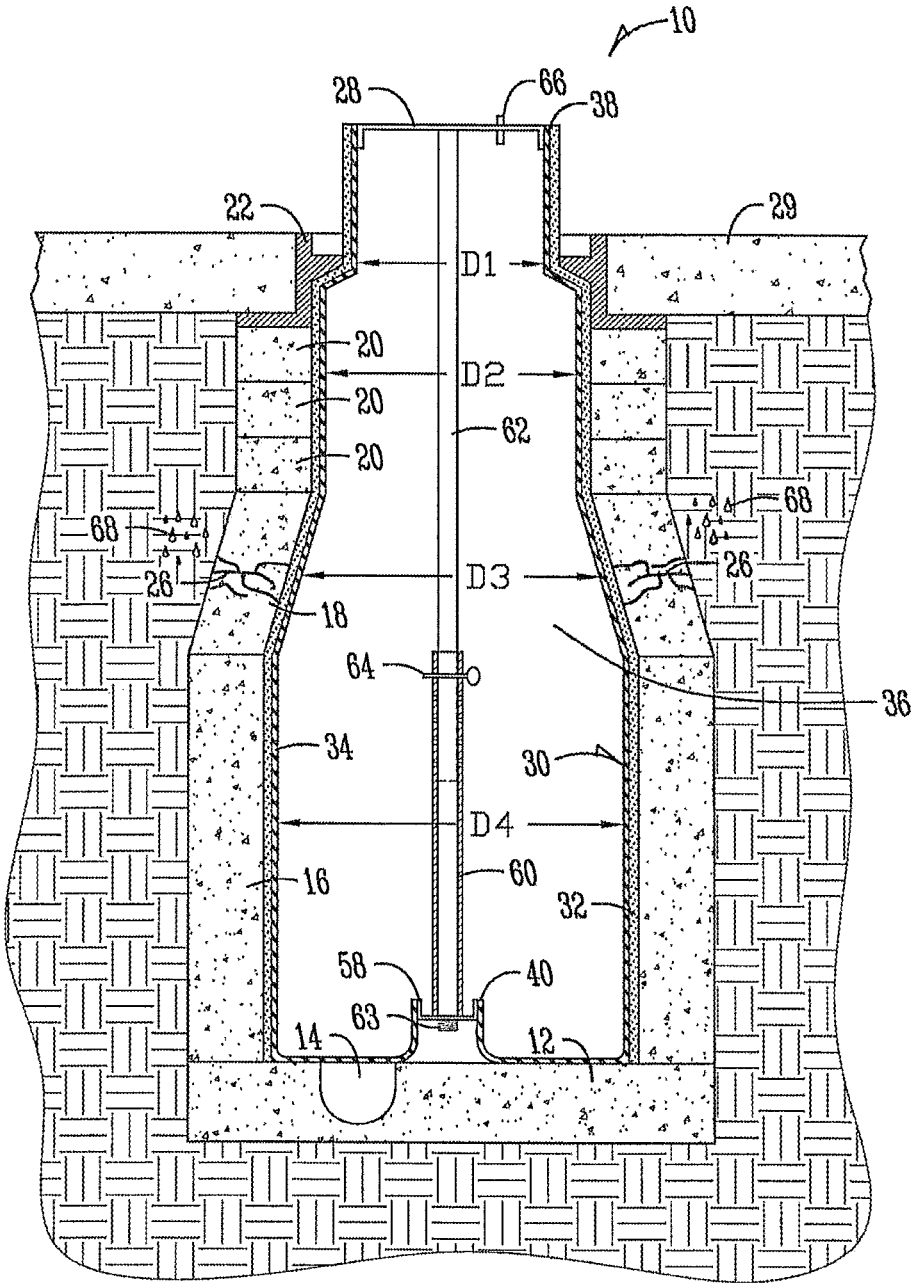
FIG. 3 is a sectional view similar to FIG. 2, but showing the embodiment in an inflated position.
Figure 4:
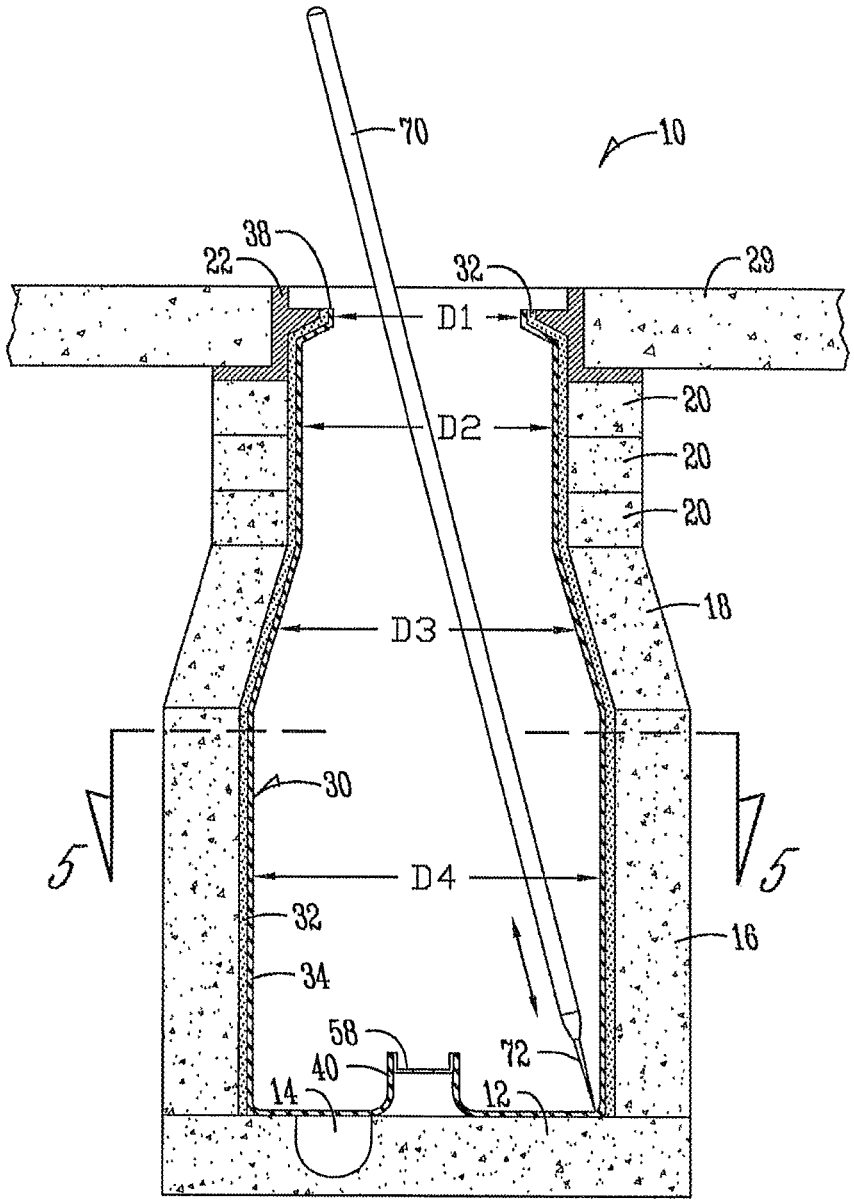
FIG. 4 is a sectional view similar to FIG. 3, showing an additional view of the embodiment of the present invention.
Figure 5:
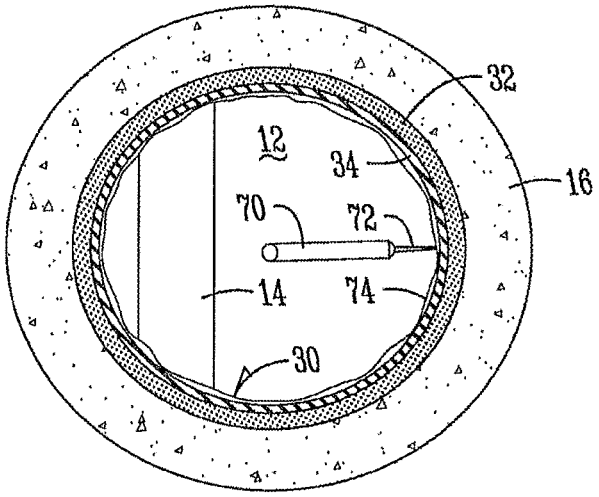
FIG. 5 is a sectional view according to line 5-5 of FIG. 4.

FIG. 2 is a sectional view of the manhole 10 of FIG. 1, but including one exemplary embodiment of the present invention. The manhole lid 21 which is level with the pavement 29 has been removed from the manhole 10. In this embodiment, a liner assembly 30 is provided. The liner assembly 30 includes a tubular sleeve 32 and a liner 34. The tubular sleeve 32 may be made of a resin impregnable material such as open cell super soft foam. It should be noted that the tubular sleeve 32 preferably is used as a carrier to transport an expandable liquid grout material to the manhole wall, and that all or nearly all (approximately 100%) of the material leaves the tubular sleeve 32 when pressed against the wall, leaving the sleeve with minimal thickness. This is illustrated in FIGS. 3-5, where the tubular sleeve 32 has been compressed to minimal thickness with the grout material having penetrated through the defects 26 in the wall 24 of the manhole 10 and to an area in the soil surrounding the manhole 10.

The tubular sleeve 32 is impregnated with either a hydrophilic or hydrophobic material capable of curing and hardening. In a preferred embodiment, a liquid hydrophobic material is used. The preferred hydrophobic material is a 2-part hydrophobic urethane thermoset resin. When parts A and B are mixed, the combination will begin to cure and harden, but will not expand into a foam material unless it comes into contact with water. One example of a suitable hydrophobic material is THR2, manufactured by Avanti International of 822 Bay Star Blvd., Webster, Tex. 77598, but other manufacturers and model numbers may be used. Hydrophobic grout materials may start to react and expand into a foam material within 20 minutes after contact with water, and can expand up to approximately 6 times their original volume. Once expanded, the hydrophobic grout or foam material will remain expanded and will continue to repel all water, whereas hydrophilic grouts require water to sustain their expanded properties.

In another embodiment of the invention, the tubular sleeve 32 is impregnated with a liquid hydrophilic material. The hydrophilic material is a one part formulation, which will not react unless in the presence of water. In the presence of water, the hydrophilic material will expand into a foam-like material, sealing water from the interior of a pipe juncture. One example of a suitable hydrophilic material is AV202 manufactured by Avanti International of 822 Bay Star Blvd., Webster, Tex. 77598, but other manufacturers and model numbers may be used. Once activated, the hydrophilic foam material will expand in volume up to approximately eight times its original volume. The hydrophilic foam material will remain flexible and resilient after full cure and will allow movement to occur in the structure without damaging the seal or bond. However, the hydrophilic foam material may shrink after cure in the absence of water.

A first end 44 of the tubular sleeve 32 and an open end 38 of the liner 34 may be connected to a flange or upper rack 28 and positioned in the manhole 10. The tubular sleeve 32 and the liner 34 may be inverted through the upper rack 28, but it will be appreciated that other positioning methods will work as well. In a preferred embodiment, the second end 46 of the tubular sleeve 32 and the second end 40 of the liner 34 reach a depth equal to the full depth of the manhole 10. Other lengths and depths can be used depending on the damage and configuration of the manhole 10. Connected to the flange 28 is a post 60 with a telescoping pole section 62. The post 60 is connected at the lower end of the manhole 10 to a lower rack 58. The post 60 may be connected to the lower rack 58 by a threaded member 63 of the post 60. A pin 64 located in the post 60 sets the proper length needed for the manhole 10. Also included in the flange 28 is an air inlet tube 66.

As an alternative to using the tubular sleeve 32 as a carrier to transport an expandable liquid grout material to the manhole wall, the material may also be applied directly to the wall of the manhole using a spin casting device, as is known in the art. The liner 34 is then inflated to force the grout material into the defects 26 of the wall 24 of the manhole. A bladder may or may not be used to inflate the liner 34, depending on whether the liner 34 includes an impermeable coating.

Referring to FIG. 3, the manhole 10 of FIG. 2 is shown, but with the liner assembly 30 fully inflated. A fluid, preferably air, is provided through the air inlet tube 66 through the flange 28 and into the cavity 36 of the liner 34. The air causes the liner to expand, pressing both the tubular sleeve 32 and the liner 34 against the wall 24 of the manhole 10. The hydrophobic material of the tubular sleeve 32 is forced from the tubular sleeve 32 and into the defects 26 of the manhole wall 24. As described above, the two part hydrophobic material will begin to cure and harden when mixed, but will not expand unless in the presence of water. However, ground water 68 may seep through the soil towards the defects 26 in the walls of the manhole 10, as seen in FIGS. 1 and 2. When the ground water 68 interacts with the hydrophobic material, the hydrophobic material expands both in the soil around the defects 26 and in the cracks, holes, and other defects themselves. FIG. 3 shows the area adjacent the defects 26 of the manhole 10 after the hydrophobic material has been forced through the defects 26 of the manhole 10 and has been introduced to the presence of water (i.e., ground water 68). The hydrophobic material will expand to form a hydrophobic foam 45. The hydrophobic foam 45 cures to create a barrier to keep water from penetrating through the defects 26 of the manhole 10. The inflation is maintained until resinous material impregnated in the liner 34 is allowed to cure and harden. The hardened liner 34 structurally renews the wall 24 of the manhole 10.

FIG. 4 shows a sectional view of the manhole 10 of FIG. 3 after the hydrophobic material of the tubular sleeve 32 has sealed the wall 24 of the manhole 10, and the liner 34 has been allowed to cure and harden to form a new wall of the manhole 10. The flange 28 and post 60 are removed from the liner assembly 30. However, the closed end 40 of the liner 34, as well as the lower rack 58, must be removed from the lower depth of the manhole 10. The removal may be done by cutting the closed end 40 of the liner 34 out of the manhole 10. The process can be done without having to enter the manhole 10. A knife 72, connected to a handle 70 is inserted into the manhole 10 to cut out and remove the closed end 40 of the liner 34. Note that in cases where liner 34 is closed off like a balloon at the floor, there is no need for the post 60 and lower rack 58.

The removal of the closed end 40 of the liner 34 is shown in FIG. 5, which is a sectional view according to the line 5-5 of FIG. 4. The knife 72 creates a circular cutout 74 in the closed end 40 of the liner 34 to allow access to the bottom paddle 12 and run through 14 of the manhole 10. However the tubular sleeve 32 is left alone.

When a liquid hydrophilic material is used to impregnate the tubular sleeve 32, an impermeable barrier (not shown) may also be used. The barrier would be placed between the tubular sleeve 32 and the liner 34. When the hydrophilic material is pressed through the defects 26 and into the soil around the manhole 10, it will not react or cure unless introduced to the presence of water, i.e. ground water 68. Water will cause the hydrophilic material to expand, but also to cure to a flexible material. In the absence of water, the hydrophilic material may shrink, which could cause damage to the cured liner 34. The impermeable, rigid barrier (not shown) will ensure that the liner 34 remains rigid, thus repairing the manhole wall 24.

Figure 8:
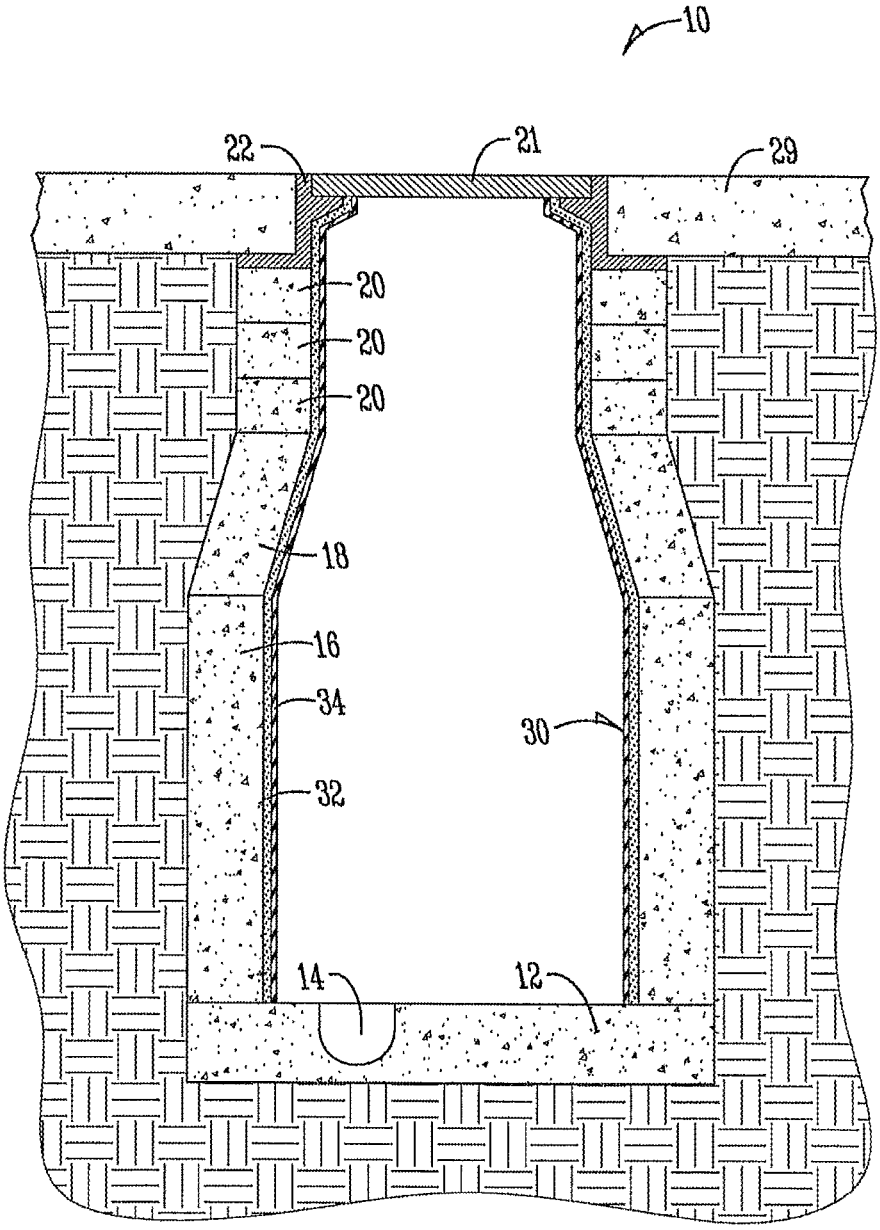
FIG. 8 is a sectional view of a manhole that has been repaired using the present invention.

Now referring to FIG. 8, a manhole that has been sealed and structurally renewed by the first exemplary embodiment of the present invention is provided. As can be seen, the tubular sleeve 32 and the liner 34 are left in the manhole 10. The hydrophobic grout of the tubular sleeve has seeped into all cracks, defects, holes, and joints, to seal the wall 24 of the manhole 10 from ground water 68. The liner 34 creates a new wall in the manhole 10. After the closed end 40 of the liner 34 is removed, access is still provided to the bottom paddle 12 and the run through 14 of the manhole 10. All other components of the liner assembly 30 are removed and the manhole lid 21 is replaced on top of the casting frame 22 which creates a flat surface with the pavement 29 around the manhole 10.

Figure 6:
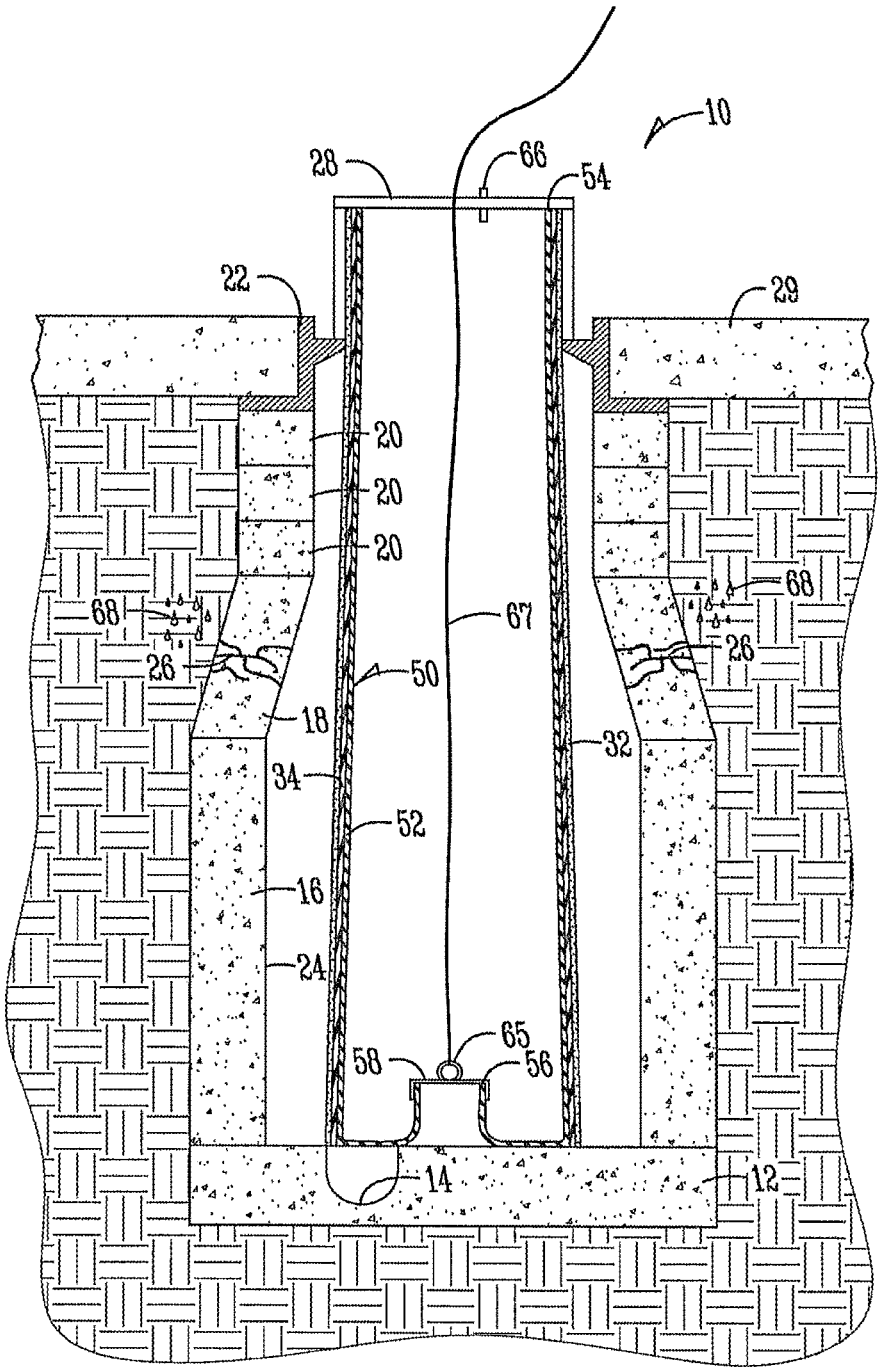
FIG. 6 is a sectional view of a manhole with defects in a wall of the manhole, showing an additional embodiment of the present invention.
Figure 7:
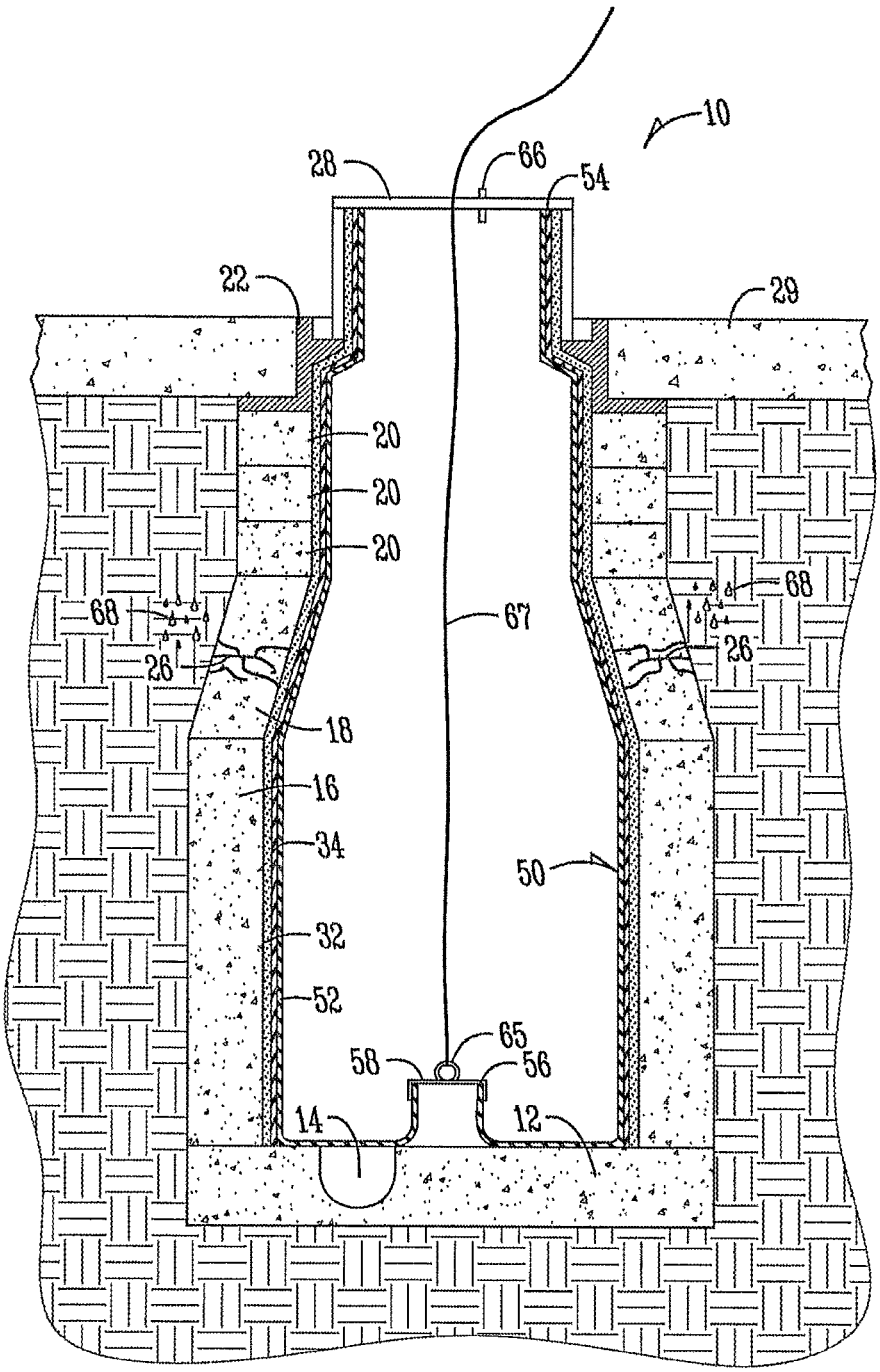
FIG. 7 is a sectional view similar to FIG. 6, but showing the embodiment in an inflated position.

FIGS. 6 and 7 show yet another exemplary embodiment of the present invention. FIG. 6 shows the same manhole 10 of FIG. 1 with defects 26 that may allow ground water 68 to seep through the wall 24 of the manhole 10, thus creating structural problems in the manhole 10. In this particular embodiment, a liner/bladder assembly 50 is provided. The assembly 50 includes a tubular sleeve 32, a liner 34, and a bladder 52. The tubular sleeve is made of resin impregnable material as stated above, and is impregnated with a hydrophobic or hydrophilic material capable of curing and hardening and expanding in the presence of water. The liner 34 is made of a resinous absorbable material, and is impregnated with a resinous material capable of curing and hardening. The liner/bladder assembly 50 is positioned in the manhole 10 with the tubular sleeve 32 nearest the manhole wall 24, the liner 34 abutted against an interior surface 42 of the tubular sleeve 32, and a bladder 52 inserted within the liner 34. The upper end 54 of the bladder 52 may be connected to a flange 28, which includes an air inlet tube 66, and which rests on the casting frame 22 of the manhole 10. The lower end 56 of the bladder 52 may be connected to a lower rack 58, which includes a hook 65 and a rope 67. Air, or another fluid, is put through the air inlet tube 66, which inflates the liner/bladder assembly 50. The bladder 52 is inflated to press the tubular sleeve 32 and the liner 34 against the wall 24 of the manhole 10. When the tubular sleeve 32 is pressed against the wall 24 of the manhole 10, the hydrophobic or hydrophilic material of the tubular sleeve 32 is forced into the defects 26 of said wall 24. The hydrophobic or hydrophilic material may come in contact with ground water 68, causing the material to expand and cure, thus sealing the wall 24 of the manhole 10 from future water damage. The bladder 52 is inflated until the resinous material of the liner 34 is allowed to cure and harden. The cured and hardened liner structurally renews the wall 24 of the manhole 10. Once the liner has cured, air may be released from the bladder 52, and the rope 67 pulls the lower end 56 of the bladder 52, which is connected to the lower rack 58 to remove the bladder. Once the bladder is removed, what is left is a sealed and structurally renewed manhole, as can be seen in FIG. 8.

The invention has been shown and described above with reference to the preferred embodiments, and it is understood that many modifications, substitutions, and additions may be made which are within the intended spirit and scope of the invention. The invention is only to be limited by claims appended hereto.

The invention claimed is:

1. A method of sealing ground water out of and structurally renewing a wall of a manhole, comprising:

impregnating a tubular sleeve with a hydrophilic or hydrophobic material;

inserting the tubular sleeve into the manhole;

impregnating a liner with a resinous material capable of curing and hardening; inserting the liner within the tubular sleeve, wherein the liner has a closed end and that the liner and the tubular sleeve are substantially contiguous;

inflating the liner to stretch the tubular sleeve and the liner into contact with the wall of the manhole;

wherein the hydrophilic or hydrophobic material is forced into cracks, holes, and other defects in the manhole wall;

allowing the resinous material of the liner to cure and harden so as to attach the liner to the wall of the manhole; and removing the closed end of the liner from the manhole.

2. The method of claim 1 wherein the liner has a lower end and the lower end of the liner is the closed end.

3. The method of claim 1 further comprising cutting out the closed end of the liner before removing the closed end of the liner from the manhole.

4. The method of claim 1 wherein the liner is inflated by applying fluid pressure within the liner.

5. The method of claim 1 wherein the hydrophilic or hydrophobic material expands up to six times its original volume when said hydrophilic or hydrophobic material comes into contact with water.

6. The method of claim 1 further comprising attaching one end of the tubular sleeve to a holding flange located outside of the manhole.

7. The method of claim 6 wherein the tubular sleeve is inverted through the flange and into the manhole.

8. The method of claim 7 further comprising attaching the open end of the liner to the flange.

9. The method of claim 8 wherein the liner is inverted through the flange and the tubular sleeve into the manhole.

10. The method of claim 1 wherein the manhole has a full depth and the tubular sleeve in inserted into the full depth of the manhole.

* * * * *